US008265328B2

(12) United States Patent
Milde et al.

(10) Patent No.: US 8,265,328 B2
(45) Date of Patent: Sep. 11, 2012

(54) EARPHONE

(75) Inventors: Lars Milde, Hannover (DE); Markus Kuhr, Singapore (SG)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 102 days.

(21) Appl. No.: 12/524,353

(22) PCT Filed: Jan. 29, 2008

(86) PCT No.: PCT/EP2008/000645
§ 371 (c)(1),
(2), (4) Date: Mar. 22, 2010

(87) PCT Pub. No.: WO2008/092620
PCT Pub. Date: Aug. 7, 2008

(65) Prior Publication Data

US 2010/0183184 A1 Jul. 22, 2010

(30) Foreign Application Priority Data

Jan. 29, 2007 (DE) ..... 10 2007 005 159

(51) Int. Cl.
*H04R 25/00* (2006.01)

(52) U.S. Cl. ..... 381/381; 381/370; 381/374; 381/379

(58) Field of Classification Search ..... 381/374, 381/379
See application file for complete search history.

(56) References Cited

U.S. PATENT DOCUMENTS

| | | | | |
|---|---|---|---|---|
| 5,412,736 | A | 5/1995 | Keliiliki | |
| 5,625,171 | A * | 4/1997 | Marshall | 181/130 |
| 5,729,615 | A * | 3/1998 | Yang | 381/370 |
| 6,097,827 | A * | 8/2000 | Yang | 381/375 |
| 7,123,737 | B2 * | 10/2006 | Ham | 381/381 |
| 2002/0080989 | A1 | 6/2002 | Chi-Lin | |
| 2005/0185814 | A1 * | 8/2005 | Chen | 381/381 |

FOREIGN PATENT DOCUMENTS

| | | |
|---|---|---|
| EP | 0158391 A1 | 10/1985 |
| GB | 2339360 A | 1/2000 |

OTHER PUBLICATIONS

PCT Search Report of the International Searching Authority mailed on Apr. 7, 2008 for International Application No. PCT/EP2008/000645; 1 page.

* cited by examiner

*Primary Examiner* — Yuwen Pan
*Assistant Examiner* — Taunya McCarty
(74) *Attorney, Agent, or Firm* — Kilpatrick Townsend & Stockton LLP

(57) ABSTRACT

There is provided an earphone having an ear hook, at one end of which is arranged a first end of a sliding shaft and at the other end of which (at the ear lobe abutment end) the cable is fixed. The housing of the electroacoustic transducer is connected to the second end of the shaft in such a way that the housing of the electroacoustic transducer can be moved in the longitudinal direction of the shaft.

4 Claims, 2 Drawing Sheets

EARPHONE

CROSS-REFERENCES TO RELATED APPLICATIONS

This application is a U.S. National Stage of PCT Application No. PCT/EP2008/000645 filed Jan. 29, 2008, which claims the benefit of German Application No. 102007005159.1 filed Jan. 29, 2007, the contents of both applications are hereby incorporated by reference in their entirety.

The present invention concerns an earphone.

DE 197 01 784 C1 discloses an earphone with an ear clip. The earphone has an electroacoustic transducer connected directly to a cable. In addition arranged on the housing of the electroacoustic transducer is a slidingly movable shaft cooperating with a sliding sleeve at one end of the ear clip in such a way as to permit a sliding movement of the shaft along its longitudinal axis. In that arrangement the ear clip is fixed to the sliding sleeve in such a way that a spiral-shaped or helical abutment end of the ear clip bears directly against the sliding sleeve. The ear clip is thus formed from a spiral-shaped or helical abutment end, an arcuately curved hook portion and an abutment end at an ear lobe end.

The object of the present invention is to provide an earphone which permits improved wearing comfort.

That object is attained by an earphone as set forth in claim 1.

Thus there is provided an earphone having an ear hook, at one end of which is arranged a first end of a sliding shaft and at the other end of which (at the ear lobe abutment end) the cable is fixed. The housing of the electroacoustic transducer is connected to the second end of the shaft in such a way that the housing of the electroacoustic transducer can be moved in the longitudinal direction of the shaft.

Further configurations of the invention are subject-matter of the appendant claims.

The embodiments by way of example of the invention and the advantages of the invention are described in greater detail with reference to the accompanying drawing.

Figure 1:
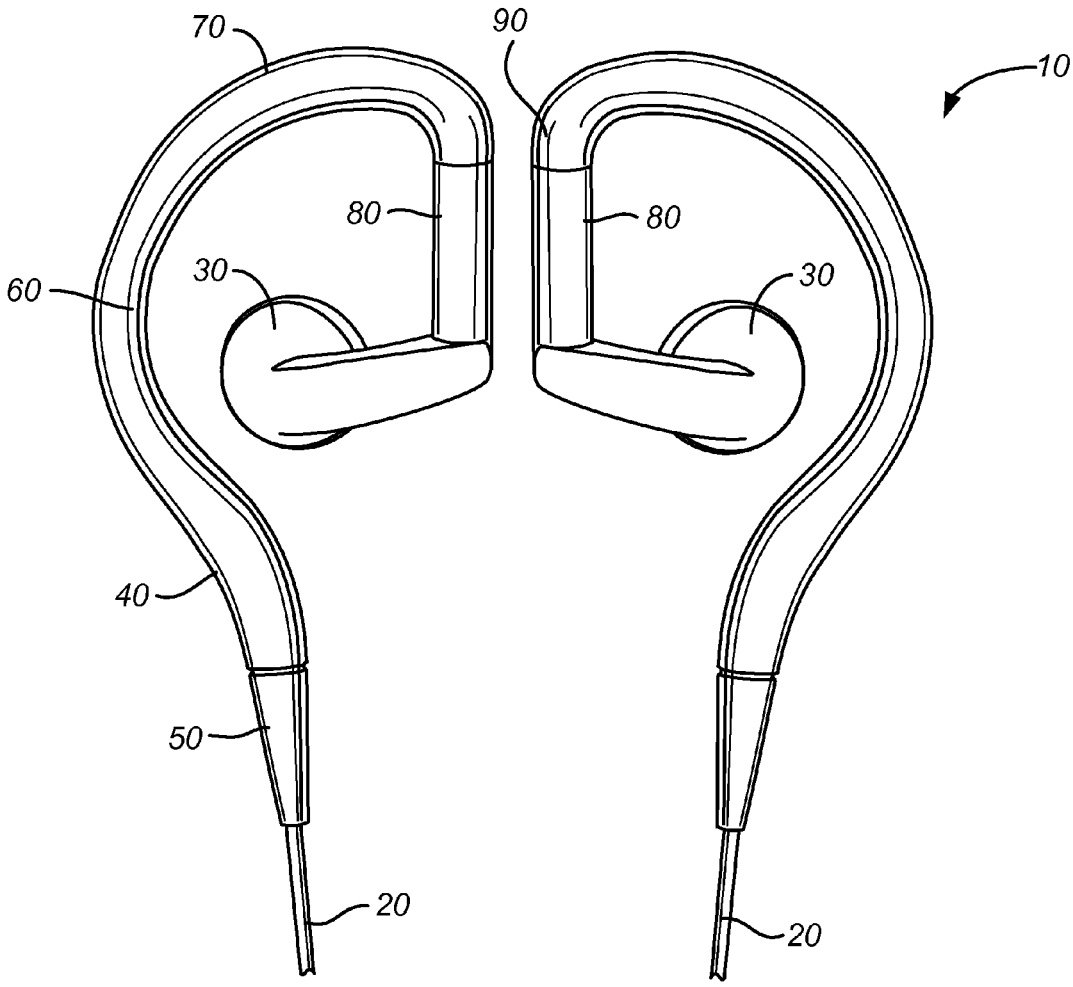
Figure 2:
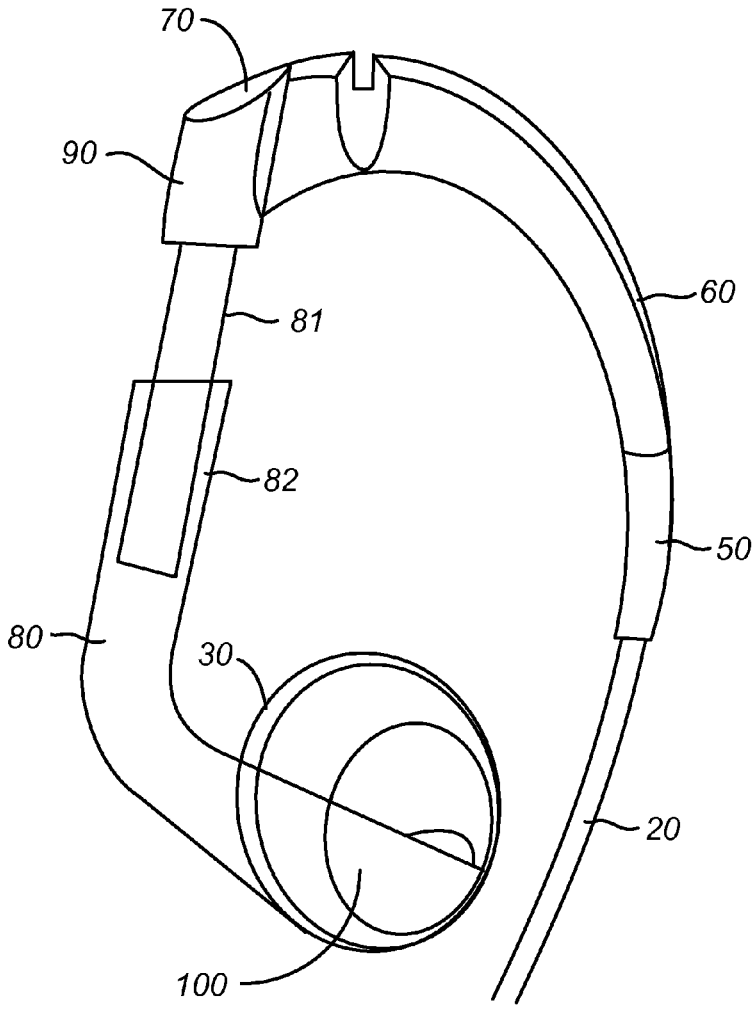

FIG. 1 shows a diagrammatic view of an earphone in accordance with the first embodiment, and FIG. 2 shows a diagrammatic view of the earphone in accordance with a second embodiment.

FIG. 1 shows a diagrammatic view of an earphone in accordance with the first embodiment. The earphone 10 is in the form of an ear clip or ear hook earphone. For that purpose the earphone has a housing 30 for the electroacoustic transducer. In this case the housing 30 is preferably integrally connected to the housing portion 80. The earphone further has the ear clip 70, 60, 40. A shaft or a tube 81 is fixed at the first end 90 of the ear clip. The feed cable 20 is fixed at the second end of the ear clip 50. A first portion 40 of the ear clip is supported in the region of the ear lobe of the wearer when the earphone is being worn. A second portion 60 of the ear clip and a third portion 70 of the ear clip bear against the ear root of the wearer when the earphone is being worn.

FIG. 2 shows a diagrammatic view of an earphone in accordance with a second embodiment. In this case the second embodiment is essentially based on the first one. Thus the earphone is in the form of an ear clip or ear hook earphone. The housing 30 of the electroacoustic transducer 100 is adjoined by a housing portion 80 which is preferably of a cylindrical configuration. In this case the ear clip or the ear hook is substantially of a hook-shaped configuration. A (slidably movable) shaft 81 is mounted at its first end 90. The cable 20 for the earphone is arranged at its second end 50. An element 82 for receiving the shaft 81 is arranged in the housing portion 80 in such a way that the housing portion 80 and the housing of the electroacoustic transducer is movable in the longitudinal direction of the shaft 81.

The fact that the feed cable is introduced at the second end 50 of the ear clip means that the cable has to be passed through the ear clip 50, 60, 70, 90 to the shaft 81 and through the shaft 81 to the housing portion 80 and to the housing 30 to be connected to the electroacoustic transducer 100.

The fact that the cable 20 is not connected directly to the electroacoustic transducer as in DE 197 01 784 C1 but is passed by way of the ear clip or the ear hook to the electroacoustic transducer means that the cable 20 can be guided in a more pleasant way. While the cable hangs down forwardly in DE 197 01 784 C1, the cable 20 in the earphones in the first and second embodiments can be guided downwardly behind the ear. On the one hand that is more comfortable to wear and on the other hand the cable 20 does not interfere when the head of the user is moved.

The invention claimed is:

1. An earphone comprising:

an ear hook which has a first and a second end, a shaft fixedly connected to the first end of the ear hook, a housing for an electroacoustic transducer, the housing fixedly connected to a housing portion having a receiving element adapted to receive the shaft in such a way that the housing portion with the housing is slidably movable in a longitudinal direction over the shaft wherein one end of the shaft is enclosed by the housing portion, and a cable fixed to the second end of the ear hook and extending from the second end inside the ear hook, inside the shaft, and inside the housing, the cable being coupled to the electroacoustic transducer.

2. An earphone as set forth in claim 1 wherein the ear hook comprises a flexible material.

3. The earphone as set forth in claim 1 wherein the housing is further integrally connected to the housing portion.

4. The earphone as set forth in claim 1 wherein the housing portion is of a cylindrical configuration.

* * * * *

UNITED STATES PATENT AND TRADEMARK OFFICE

CERTIFICATE OF CORRECTION

PATENT NO. : 8,265,328 B2
APPLICATION NO. : 12/524353
DATED : September 11, 2012
INVENTOR(S) : Milde et al.

It is certified that error appears in the above-identified patent and that said Letters Patent is hereby corrected as shown below:

In the Specification:

Column 1, Line 40: please delete “drawing” and insert --drawings--.

Column 2, Line 16: please delete “is” and insert --are--.

Signed and Sealed this
Eighth Day of January, 2013

David J. Kappos

David J. Kappos
*Director of the United States Patent and Trademark Office*